US010730176B2

(12) United States Patent
Plehn-Citrone

(10) Patent No.: US 10,730,176 B2
(45) Date of Patent: Aug. 4, 2020

(54) HAND TOOL

(71) Applicant: David Plehn-Citrone, Woodland Hills, CA (US)

(72) Inventor: David Plehn-Citrone, Woodland Hills, CA (US)

( * ) Notice: Subject to any disclaimer, the term of this patent is extended or adjusted under 35 U.S.C. 154(b) by 139 days.

(21) Appl. No.: 15/887,612

(22) Filed: Feb. 2, 2018

(65) Prior Publication Data

US 2018/0222021 A1 Aug. 9, 2018

Related U.S. Application Data

(60) Provisional application No. 62/454,618, filed on Feb. 3, 2017.

(51) Int. Cl.

| | |
|---|---|
| ***B25G 1/10*** | (2006.01) |
| ***B25G 1/08*** | (2006.01) |
| ***B25B 15/04*** | (2006.01) |
| ***B25B 23/00*** | (2006.01) |
| ***B25B 13/56*** | (2006.01) |
| *B25B 15/00* | (2006.01) |

(52) U.S. Cl.

CPC ..... *B25G 1/102* (2013.01); *B25B 13/56* (2013.01); *B25B 15/04* (2013.01); *B25B 23/0035* (2013.01); *B25G 1/085* (2013.01); *B25G 1/105* (2013.01); *B25B 15/005* (2013.01); *B25B 15/007* (2013.01)

(58) Field of Classification Search

CPC ..... B25G 1/102; B25G 1/105; B25G 1/005; B25G 1/002; B25G 1/085; B25B 15/04

See application file for complete search history.

(56) References Cited

U.S. PATENT DOCUMENTS

| | | | | |
|---|---|---|---|---|
| 4,893,529 | A * | 1/1990 | Lin | B25G 1/005 81/177.4 |
| 6,089,133 | A * | 7/2000 | Liao | B25B 15/02 81/177.2 |
| 7,073,417 | B2 * | 7/2006 | Beauchamp | B25F 5/029 81/177.4 |
| 2008/0271578 | A1 * | 11/2008 | Marks | B25B 13/461 81/185 |
| 2013/0276240 | A1 * | 10/2013 | Gresham | B25F 1/006 7/138 |
| 2015/0047473 | A1 * | 2/2015 | Ryans | B25B 13/48 81/63.1 |
| 2017/0266790 | A1 * | 9/2017 | Chuang | B25B 23/0035 |

FOREIGN PATENT DOCUMENTS

JP 2001105336 A * 4/2001

* cited by examiner

*Primary Examiner* — Daniel J Colilla

(74) *Attorney, Agent, or Firm* — Colin P. Abrahams

(57) ABSTRACT

A hand tool comprises a handle having a central area having a lower end and an upper end and a pair of outwardly extending arms at the upper end, and a shaft having a fixed end connected to the lower end of the central area and an open opposite end for receiving a tool bit. A ratchet mechanism is formed between the shaft and the central area to control rotational movement of the shaft. A ring is releasably mounted on the shaft and capable of limited movement relative to the shaft.

15 Claims, 9 Drawing Sheets

HAND TOOL

CROSS-REFERENCE TO RELATED APPLICATIONS

This application claims the benefit of U.S. Provisional Patent Application No. 62/454,618 filed on Feb. 3, 2017, the contents of which are incorporated herein by reference in their entirety.

FIELD AND BACKGROUND OF THE INVENTION

This invention relates to a hand tool. More particularly, the invention relates to a hand tool which is used primarily as a screwdriver. The hand tool of the invention preferably comprises a screwdriver incorporating a handle which is ergonomically designed, a selectively ratcheted mechanism to facilitate operation of the hand tool, and a storage rack or component mounted on the hand tool for holding a plurality of screwdriver bits or other desired hardware.

SUMMARY OF THE INVENTION

According to one aspect of the invention, there is provided a hand tool comprising: a handle having a central area having a lower end and an upper end and a pair of outwardly extending arms at the upper end; a shaft having a fixed end connected to the lower end of the central area and an open opposite end for receiving a tool bit; a ratchet mechanism between the shaft and the central area to control rotational movement of the shaft; and a ring releasably mounted on the shaft and capable of limited movement relative to the shaft.

Preferably, the central area of the handle is substantially coaxial with the shaft, and the outwardly extending arms extend upwardly from and away from the central area of the handle, the outwardly extending arms and the central area defining a generally Y-shaped configuration for the handle. A circular disk may be formed at the top of the central area between the outwardly extending arms.

In a preferred embodiment, the central area of the handle comprises an internal chamber for receiving the ratchet mechanism. The ratchet mechanism may control the rotational movement of the shaft, the ratchet mechanism selectively permitting at one time movement of the shaft selected from the following: clockwise rotation, counterclockwise rotation, both clockwise and counterclockwise rotation, and no rotation. Preferably, the ratchet mechanism comprises an outer switch accessible by the user for selecting the nature of rotation of the shaft.

In one embodiment, the ring comprises an inner surface for engagement with the shaft, and an outer surface. The inner surface of the ring may be of a diameter which is, at least partially, substantially the same as the diameter of the shaft, the inner surface engaging the shaft in a manner so that it will normally remain at a fixed point thereon, but can be moved or rotated relative to the shaft by the application of moderate force. Preferably, the outer surface of the ring is generally flat and comprises a holding or gripping surface to help the user stabilize or position in the hand tool. The ring may comprise a plurality of pockets or compartments each for receiving a selected bit such that the ring operates as a storage site for selected bits.

Preferably, the open opposite end of the shaft is adapted so as to releasably receive a tool bit, and may be substantially the same size as the compartments in the ring so that a selected tool bit can be received and accommodated in both the compartment and open opposite end of the shaft.

In one aspect, the hand tool forms part of a kit. The kit may comprise a selection of different tools including bits, nut setters, extension components, drill bits, Phillips screwdriver head, and base storage units for holding said different tools when not in use.

According to a further aspect of the invention, there is provided a method of forming a hand tool comprising: forming a handle having a central area having a lower end and an upper end and a pair of outwardly extending arms at the upper end; inserting a shaft having a fixed end connected to the lower end of the central area, the shaft having an open opposite end for receiving a tool bit; inserting a ratchet mechanism between the shaft and the central area to control rotational movement of the shaft; and mounting a ring assembly releasably on the shaft which is capable of limited movement relative to the shaft.

In a further aspect of the invention, there is provided a method of operating a tool, the tool having a handle and a shaft, wherein a user engages the handle of the tool and turns the handle with the combined forearm and wrist which are substantially coaxial with the shaft.

This invention relates to a hand tool, and preferably one having a number of convenience and comfort features, and which may be ergonomically configured for easy operation and less stress on the uses hand. More particularly, the invention is for a hand tool with an ergonomic configuration, and which has a body or handle portion and a tool portion attached to the body portion, the handle being constructed in a manner such that the hand tool can be held by the user to facilitate optimal force and torque during the operation of the hand tool. Additional comfort and convenience components include a screwdriver ratchet mechanism, and onboard bit or tool part storage component, rigid and flexible extender of members. The hand tool of the invention may further come as part of a kit including a number of accessories and convenience packages which users may often require during normal use of the hand tool.

Tools such as screwdrivers are well known and have been in use for many years. A typical screwdriver comprises a handle and a tool portion, the tool portion having a tip which fits into the head of the screw. The tip of the screwdriver may be, for example, of the flat tip variety, or it may have a tip commonly referred to as a Phillips. In some instances, the tool portion may be releasably mounted within the handle, so that different sizes or varieties of tool may be inserted therein. Further, some screwdrivers may have ratchet operations so that rotation of the screwdriver about its longitudinal axis will drive the screw when turned in one angular direction, but not in the other angular direction. A ratchet operated screwdriver will often have the ability to reverse so that the direction of rotation of the screw driving operation can be selected by the user to be clockwise or counterclockwise. Of course, the ratchet mechanism may be adjusted according to the user's preference so that the screwdriver will be operated when being rotated in either a clockwise or counterclockwise direction.

Almost all conventional screwdrivers tend to have a handle portion which is generally cylindrical or tubular in shape, and the tool portion is embedded within the handle portion. The handle portion may have indents or surface texture to help the user with the secure gripping of the handle. Such screwdrivers must be held by the user so that the thumb and fingers grip and hold the handle portions for proper operations. A consequence of this arrangement is that the turning motion of the screwdriver handle must be effected largely or at least significantly by the movement of the wrist of the user. Furthermore, due to the structure of the cylindrical handle, the axis of the user's forearm will almost certainly be out of alignment with the axis of the tool itself.

A typical screwdriver having the cylindrical handle will therefore require most of the torque for driving the screw to originate from the wrist, and the force will be provided by the applied pressure from the palm of the hand, which is most likely out of axial alignment with the forearm.

In one aspect, the present invention provides an ergonomically configured hand tool wherein the handle portion thereof can be held by the user in a manner which allows increased functionality by facilitating a grip or holding of the tool in a manner where at least a part of the torque and force required to drive the screw into a substrate can be more readily supplied by the forearm of the user, and potentially the whole arm and body as well. In this way, the ergonomically configured hand tool of the invention is not only more comfortable, but is also considerably more efficient since it allows the body of the user, and particularly the arm and forearm, to be effectively used to provide the necessary torque and downward force for driving a screw into the desired substrate.

The ergonomically configured hand tool of the invention provides a handle which can be gripped by the user to increase axial alignment between the forearm and the hand tool, and wherein the tool portion of the hand tool is attached to the handle by means of a ratchet assembly so that the user can drive the screw into the desired substrate by simply rotating the forearm and wrist in an alternating clockwise and counterclockwise movement. The design of this ergonomic hand tool therefore provides an increased level of comfort and usability, as well as an improvement in performance so that the downward force on the screw and torque required to turn the tool can be optimized.

The hand tool of the present invention may further comprise a ring or other structure which can be mounted on the shaft, and which will generally not slide or fall off the shaft due to tightness and frictional engagement therebetween. However, the ring is movable relative to the shaft, and can be rotated thereon, and slid up and down on the shaft. This ring may be used by the user to hold and stabilize the hand tool while the hand tool is in use, since it will not turn or move with the hand tool when held sufficiently tightly by the user, and the shaft upon which it is mounted is rotating in and axial manner as it is turned back and forth by the user. It is also to be noted that this ring may comprise a series of radial or spaced compartments or housings in or on its structure, with these compartments being adapted to receive selected screwdriver bits or other tools, which can be used in the hand tool as will be described further below.

Thus, the torque or twisting force of the hand tool in accordance with the invention may be provided by both the forearm and wrist of the user, and the downward axial force can be provided by the hand and forearm. This is in contrast to conventional screwdrivers where so much of the driving force must be provided by the wrist, which must be used in the rotating and twisting movement, while the fingers must tightly grip the handle of the screwdriver.

According to one aspect of the invention, there is provided a hand tool which may be ergonomically configured, the hand tool comprising a handle portion, the handle portion having a cylindrical portion with a pair of laterally extending arms at one end thereof and a ratchet device at an opposing ends thereof, the ratchet device receiving or holding a tool portion, wherein the handle portion and laterally extending arms can be held by the user for at least partial alignment with the wrist and forearm so that the hand tool can be operated by alternating clockwise and counterclockwise movement, the force of which is at least in part provided by the forearm.

Preferably, the laterally extending arms are opposed arms at an angle to the cylindrical portion such that the arms taper or extend upwardly and away from the handle portion to provide a valley or recess at the top of the hand tool. In one embodiment, a spherical or cylindrical disk or device rests within the valley or recess. This cylindrical disk or device may constitute a rest or base for the hand, and preferably the cushion or palm of the hand, while the tool is in use.

The ratchet device is preferably embedded within the cylindrical portion, and preferably an expanded diameter portion thereof, and may be one which can releasably capture screwdrivers, bits, or other selected tools according to the needs of the user. The ratchet is formed within the cylindrical portion such that the tool is held in a manner whereby its axis is coaxial with that of the cylindrical portion. The ratchet mechanism may be set by the user to be reversible in nature, so that the driving rotation may be either the clockwise or counterclockwise rotation as determined by the user. Further, the ratchet may be set such that both clockwise and counterclockwise terms are operational, according to the preferences of the user

DETAILED DESCRIPTION OF THE INVENTION

Figure 1:
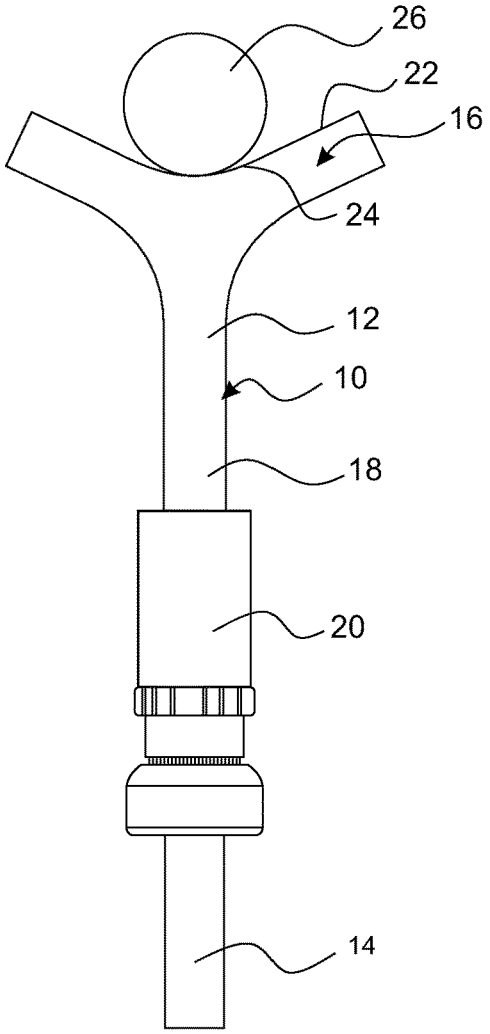
FIG. 1 is a schematic view of an ergonomically configured hand tool constructed in accordance with one aspect of the present invention.
Figure 2:
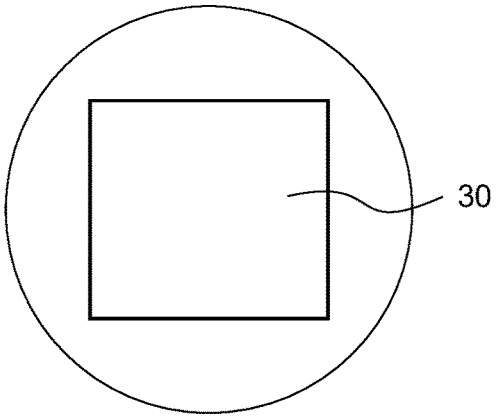
FIG. 2 is an end view of the handle of the tool illustrating the aperture for receiving the ratchet assembly.

With reference to the figures, there is shown a ergonomically configured hand tool 10 comprising a handle 12 and a tool portion 14. The handle 12 is generally of cylindrical shape, and includes an upper portion 16, a cylindrical central portion 18, and a ratchet portion 20, which is generally of expanded diameter compared to the central portion 18. All of these handle portions and the tool portion 14 are generally coaxial.

The upper portion 16 comprises a pair of lateral arms 22 extending outwardly and upwardly from the central portion 18. The pair of lateral upper arms 22 may be at an angle which varies so as to accommodate the comfort of different uses. The pair of lateral upper arms 22, together with the central portion 18, defines a recess 24 or concave portion. A circular disk 26 is attached to the base of the recess 24, and may form a base or resting point upon which the palm of the user's hand may rest during use of the hand tool.

The handle includes an enlarged cylindrical portion which contains a square aperture 30, the aperture 30 receiving the ratchet assembly 32. The ratchet assembly 32 receives a tool portion 34 which may be releasably accommodated therein so that different tool portions 34 according to the needs of the user may be selectively inserted in the ratchet assembly 32 to accomplish different tasks.

Figure 3:
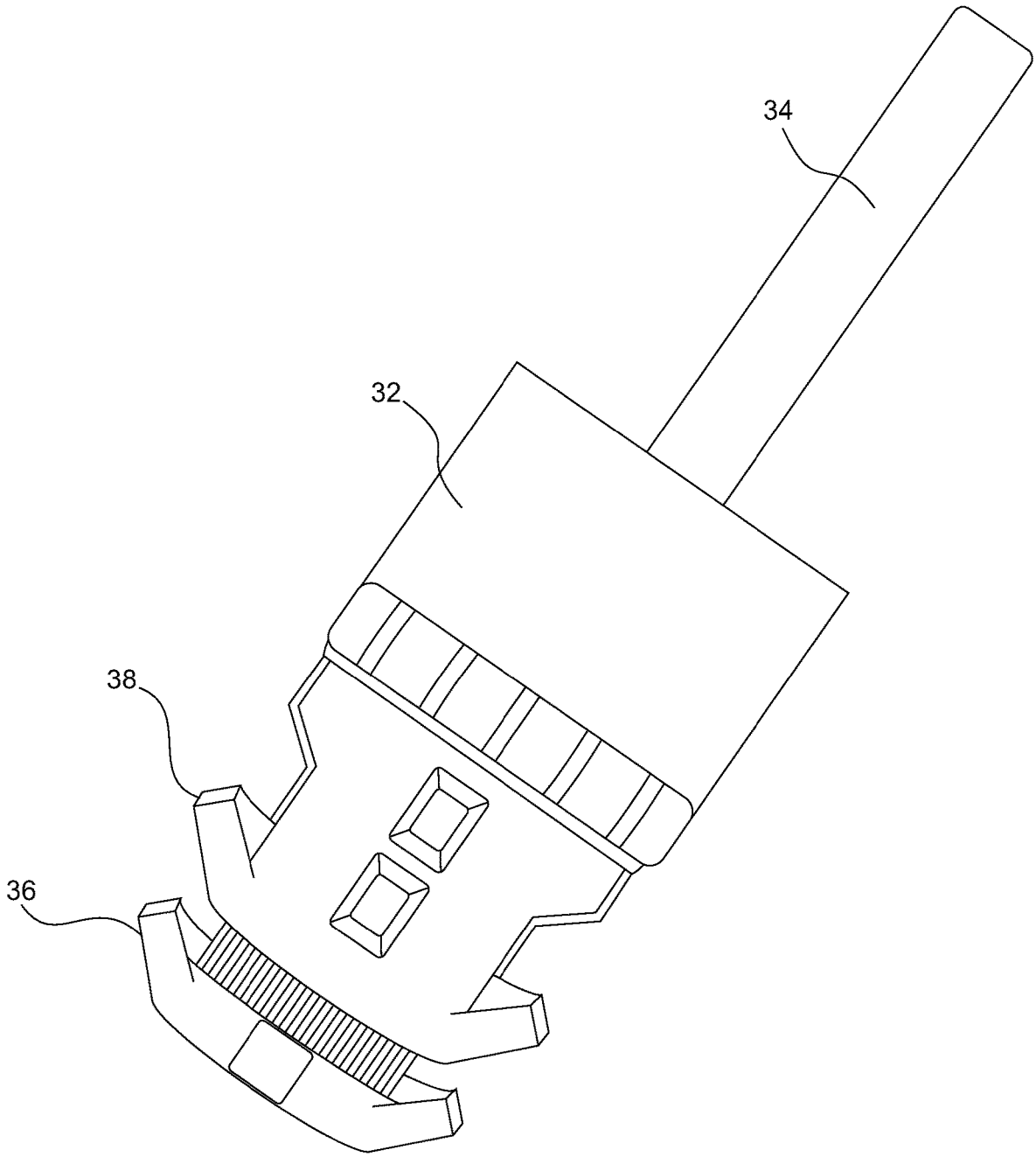
FIG. 3 is a schematic side view of a ratchet assembly for use with a tool in accordance with the present invention.
Figure 4:
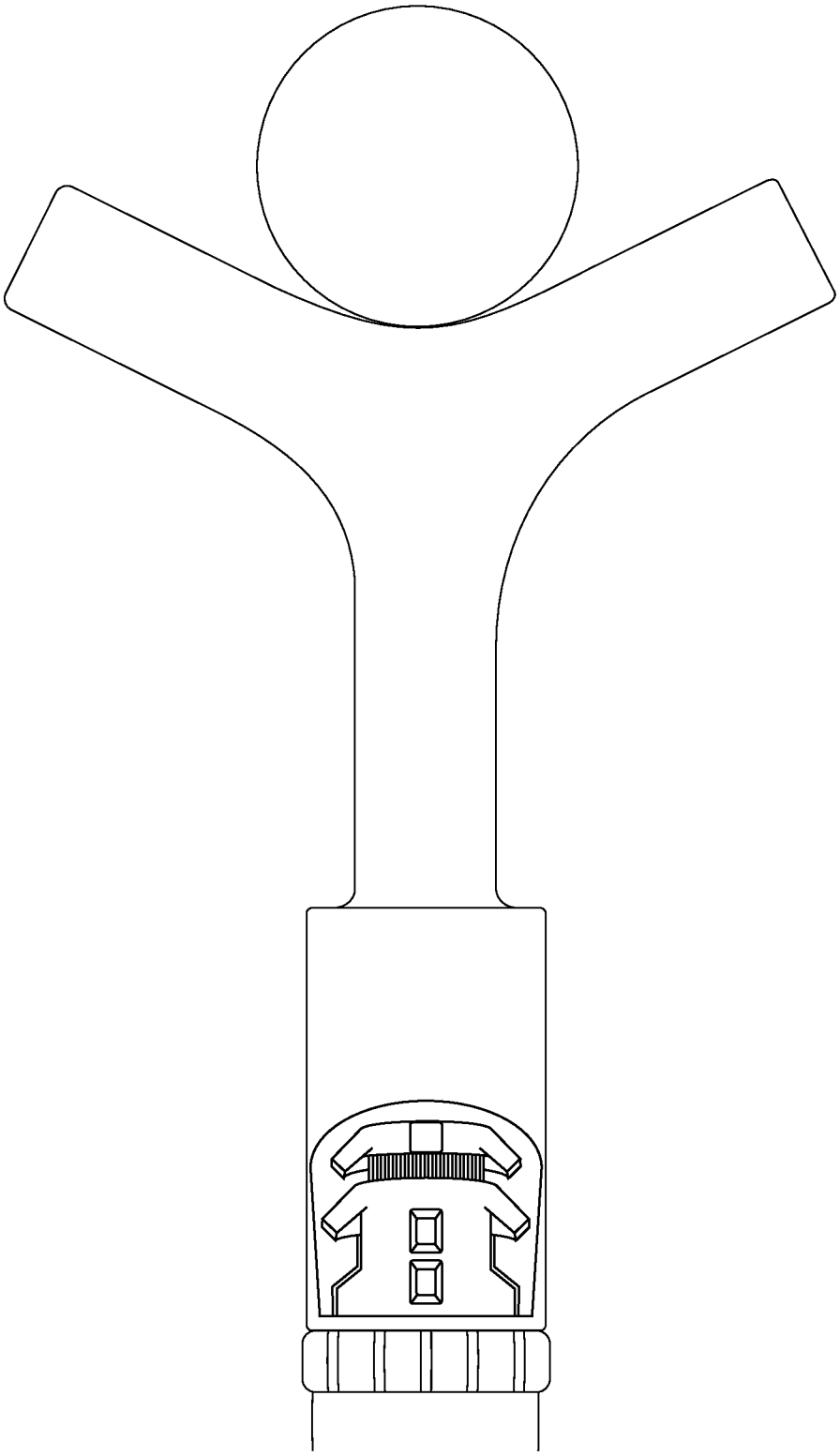
FIG. 4 is a schematic front view of an ergonomically configured hand tool in accordance with the invention, including a partial cutaway of the housing to provide a view of the ratchet assembly formed therein.

In a further embodiment, the tool portion 34 illustrated in FIG. 3 of the drawings may have an end 40 with an aperture 42 there in. The aperture 42 may be designed to receive selected replaceable bits or other tools, as will be described below, so that an appropriate but may be used by the user which best matches the job being performed.

The ratchet assembly 32 operates in a conventional manner, with internally formed wheels or racks which engage with a pawl thereby allowing rotational movement in one direction only at any one time. (Settings may of course be possible so that the ratchet operates when turned in either direction, or does not engage at all in either direction, or engages in a reverse direction.) Furthermore, the ratchet assembly 32 allows the active movement or rotation to be either clockwise or counterclockwise, and such movement may be set by the user depending upon the nature of the task to be accomplished. The clockwise rotation would typically be used for inserting screws into a substrate, while the counterclockwise rotation may be used for removing or loosening screws in a substrate. The ratchet assembly 32 is received within the aperture 30, and includes flanges 36 and 38 which engage with structure within the aperture 30 or chamber so that the ratchet assembly 32 does not fall out of the aperture 30, and is sufficiently attached to ensure that it will remain so positioned while the two is in use. It will be appreciated that, while one embodiment is shown herein, invention is not intended to be limited by the nature in which the ratchet assembly or equivalent component may be received, accommodated or fastened within the handle section of the hand tool.

Figure 7A:
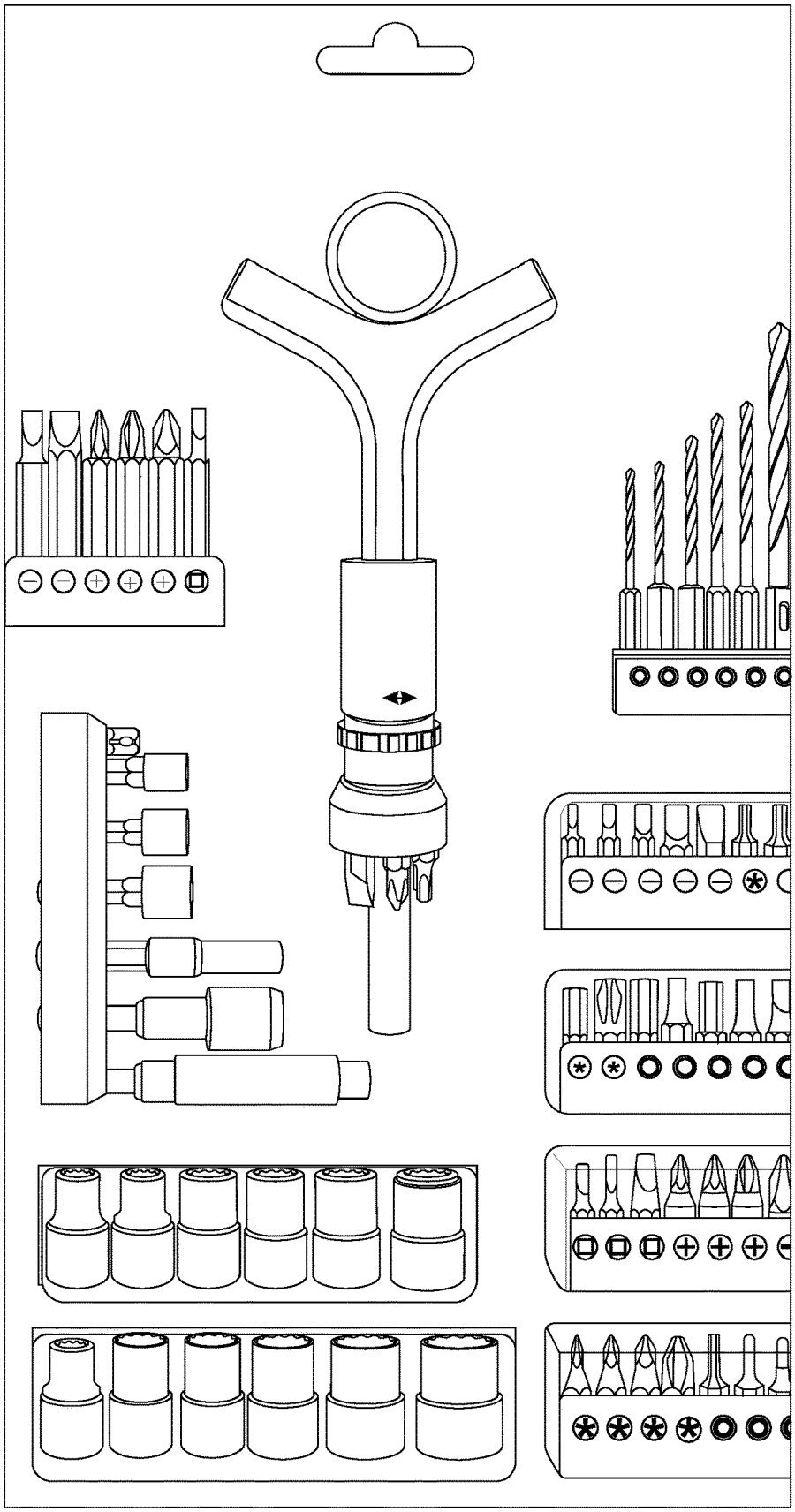
FIGS. 7A and 7B are views of a hand tool in accordance with the present invention comprising a kit including the hand tool and a plurality of tool portions having different sizes and functionalities.
Figure 7B:
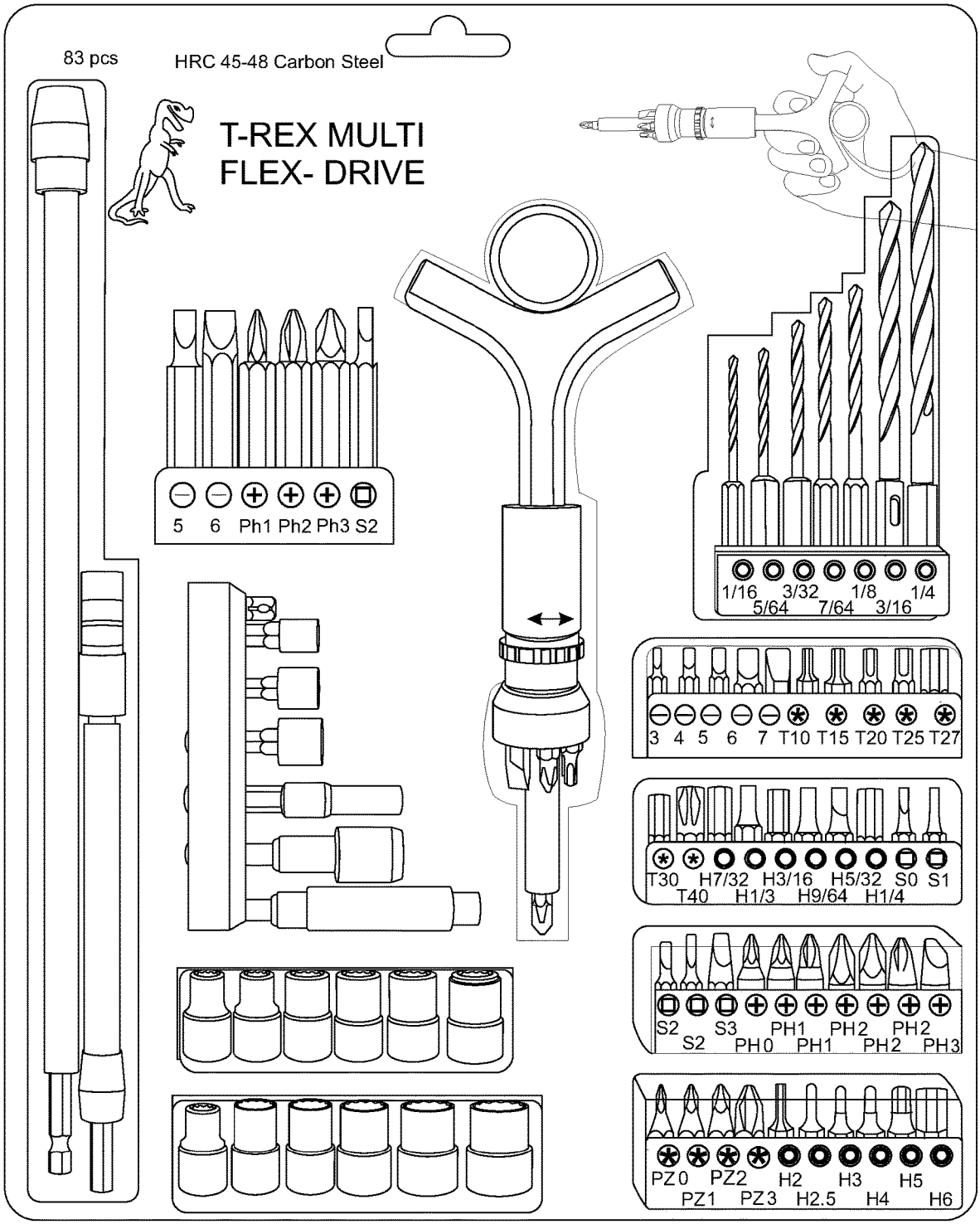

As shown in FIGS. 7A and 7B of the drawings, the ergonomically configured hand tool 10 may be a part of a kit which includes a variety of tools such as screwdriver shafts, drill bits, wrench components, to name some examples only, which can be used with the hand tool 10. Further, screwdriver extenders, and spring-loaded or sprung shafts may be provided in the kit. A spring-loaded shaft appropriately inserted may assist in applying or removing screws in a substrate where direct access may be difficult, and there is no unimpeded or straight line of access between the hand tool 10 and the relevant part of the substrate which may require work.

Figure 5:
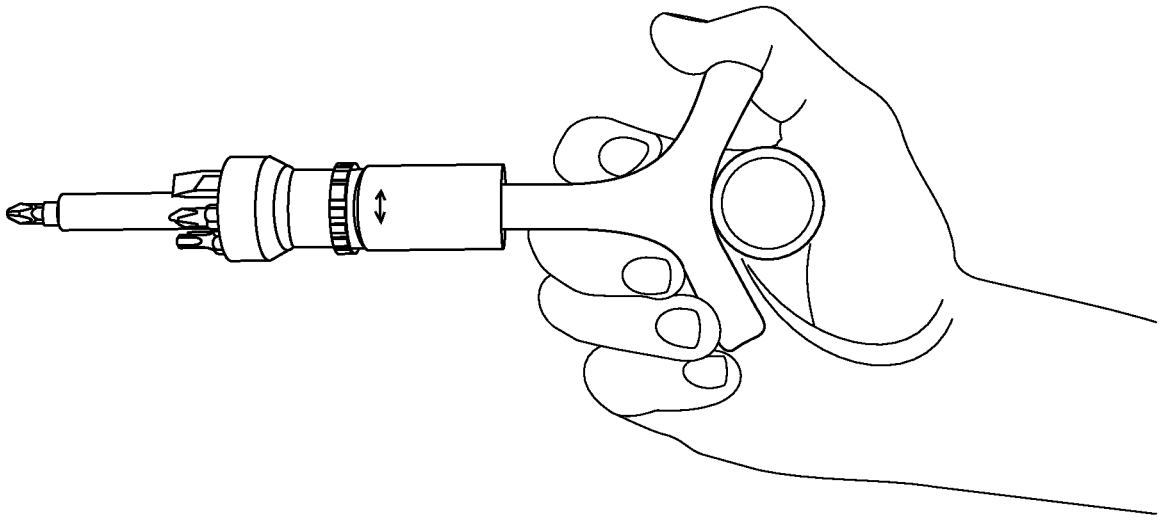
FIG. 5 is a view of a hand tool in accordance with the present invention as it may be held by the user.
Figure 6:
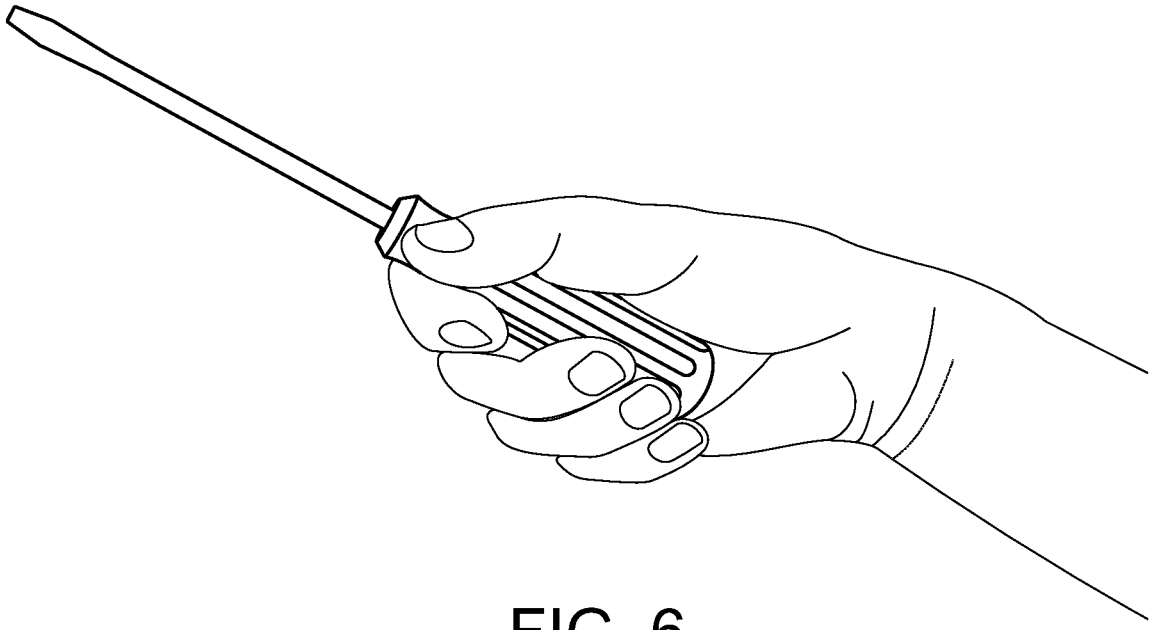
FIG. 6 is a view of a conventional screwdriver as held by a user.

FIGS. 5 and 6 of the drawings show the ergonomic advantage of the hand tool 10 in accordance with the present invention. FIG. 5 of the drawings shows how the hand tool is grasped by the user. The index and other fingers may be comfortably placed around the central portion 18 of the hand tool 10, while the fingers and thumb together engage with the lateral portions. The thumb may conveniently rest on an end of one of the lateral arms. The cushion area of the part of the hand preferably rests against and is able to apply force to the circular disk 26. The hand and forearm are behind the hand tool 10 and, preferably, the forearm is more or less axially aligned with the axis of the hand tool 10 so that downward pressure on the hand tool 10 is less likely to have to deal with lateral forces, and an increased amount of pressure is therefore placed on the screw. Overall, less force may therefore be necessary to achieve the same result as would normally be required with a conventional screwdriver.

FIG. 6 of the drawings shows, for comparative and illustrative purposes, the holding of a conventional screwdriver, in which the handle thereof is cupped by the user's hand. The nature of the manner in which it is held forces the user to utilize a significant amount of wrist torque in order to drive the screw. The traditional arrangement tends to place the user's hand to the side of the screwdriver handle rather than behind it. Unlike the arrangement of the tool of the present invention, where the axis of the forearm may be in substantial alignment with the axis of the tool, a conventional screwdriver does not have this advantage.

In FIG. 5 of the drawings, the hand tool 10 is held in the manner as illustrated in this drawing, and alternating rotational or generally axial movement of the forearm and hand, coordinating with the ratchet mechanism, allows the user to much more easily drive a screw into the desired substrate. In the hand tool of the present invention, much of the torque or twisting force necessary to turn the hand tool is transferred from the wrist, which is typical of a conventional screwdriver, to the combination of the hand and forearm, while the downward force behind the hand tool is to a large extent provided by the cushion on the palm of the hand, which also has the force of the forearm, and hence body, behind it. The hand tool 10 of the invention also is much more likely to ensure that there is no slippage of the handle, since the handle is no longer merely a cylindrical component, but has the lateral arms extending outwardly therefrom, and these can be utilized by the operator to improve and provide better leverage for the torque movement. The presence of the lateral arms provide an outwardly extending structure to which a significant force can be applied without the likelihood of slippage occurring. Slippage may easily occur when working in a somewhat moist environment, or the user may have sweat or grease on his hands which impacts the ability to use a conventional screwdriver optimally. The hand tool of the present invention goes a long way towards minimizing or eradicating this situation.

FIGS. 5 and 6 therefore help to illustrate the forearm-to-hand alignment differences created by using the ergonomic hand tool in accordance with the invention as compared to the non-ergonomic traditional 200 year old handle (FIG. 6), which causes the wrist to become unnaturally out of alignment when employing its usage.

Figure 8:
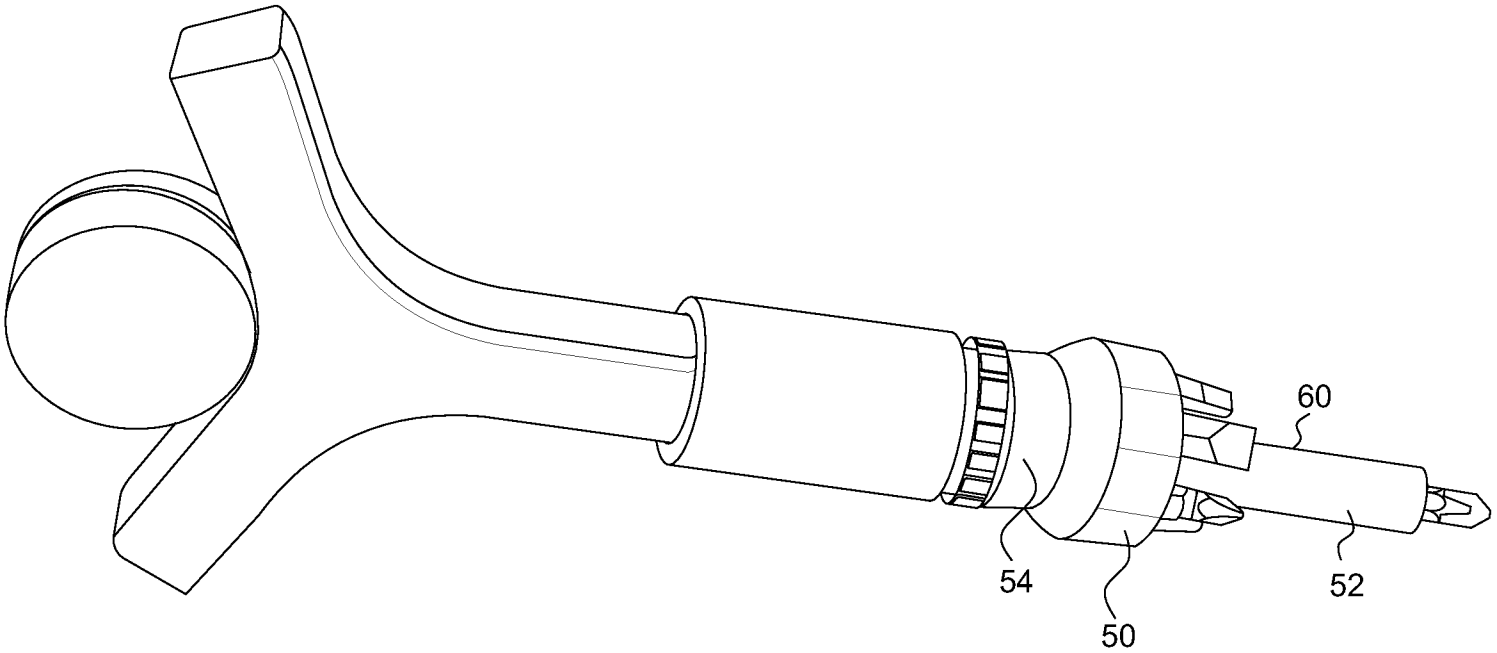
FIG. 8 is a side perspective view of a hand tool with an ergonomic configuration, ratchet and ring and storage device constructed in accordance with one aspect of the present invention.
Figure 9:
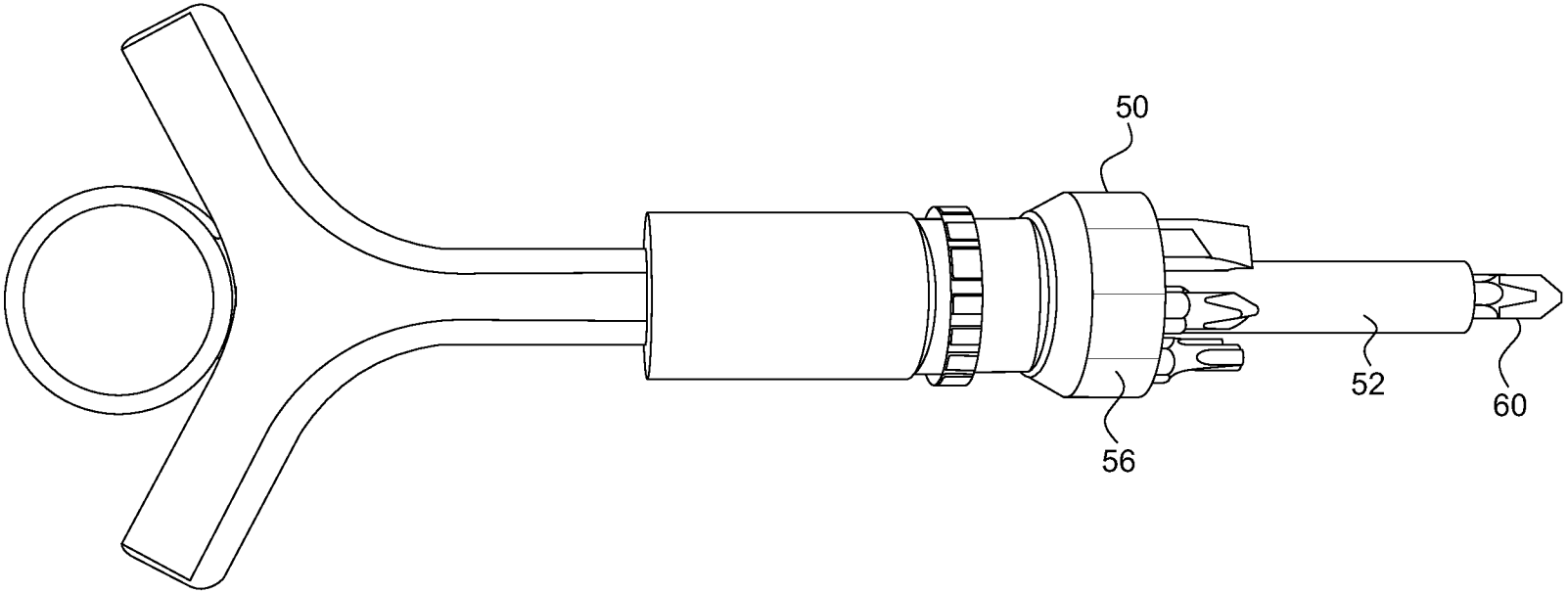
FIG. 9 is a front view of a hand tool with an ergonomic configuration, ratchet and ring and storage device constructed in accordance with one aspect of the present invention.
Figure 10:
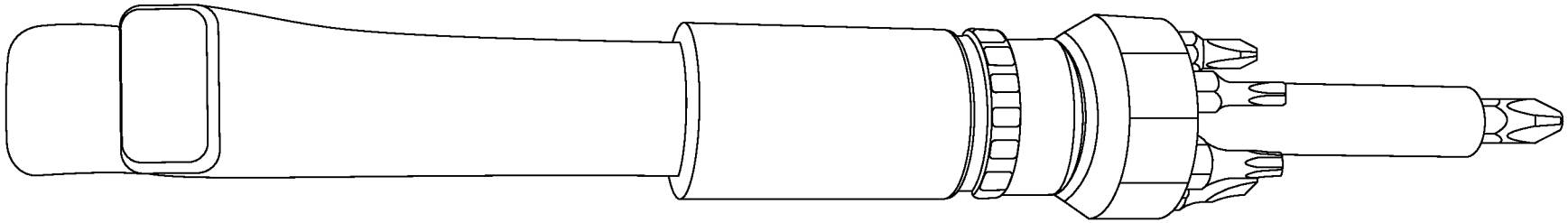
FIG. 10 is a top side perspective view of a hand tool with an ergonomic configuration, ratchet and ring and storage device constructed in accordance with one aspect of the present invention.

FIGS. 8 to 10 show perspective, front and side views of the ergonomically configured hand tool constructed in accordance with one aspect of the present invention.

It can be clearly seen by a comparison of these figures that the hand tool in accordance with the present invention maintains cohesive alignment of the forearm through the wrist, palm and fingers at all times. Conversely, as shown in FIG. 6, the opposite effect can be demonstrated: this requires strenuous squeezing with fingers, while rotating with the wrist causing the fingers, palm and wrist to become significantly out of alignment with the forearm, resulting in potential short and long term injury due to straining or repetitive motion. The very real threat of "slippage" or dropping is greatly enhanced by this conceptually flawed and outdated design.

The ergonomic hand tool in accordance with the invention is able to substantially eliminate both slipping and dropping by its through-the-fingers design, which inhibits the tool from working its way loose from the operator's hand or being dropped accidentally.

The effective use of the hand tool of the invention typically requires that the ratcheting head or mechanism must be attached to the unibody handle by inserting a piece that is part of the ratcheting head component, through the plastic injection mold process at the moment of manufacture. For this to be accomplished, a physical requirement for an expanded barrel or central portion has been made so that the ratcheting mechanism can be appropriately accommodated and maintain the coaxial structure which facilitates the effective use of the hand tool.

With the provision of a and expanded barrel and ratcheting head to the design, a truly unique and novel utility tool has been created. A true ergonomic ratcheting driver is thus provided which is able to be single-handedly operated safely (only the natural flexing of the forearm is required to engage ratcheting mechanism) and in perpetuity, from all angles without the risk of slippage or dropping. Furthermore, the ability to store use the hand holding the driver to grip other objects simultaneously is maintained, something which is impossible or at best very difficult when using the conventional and traditional screwdriver handle which has been around for centuries.

The previous variant of the configured handle requires 2 hands to operate and cannot be used in "perpetuity" as a result. Additionally other ratcheting 'T' driver designs lack both the 45 degree "arched" upward sweep, as well as the "palm pressure point head" for including and maintaining even pressure from the palm during usage.

FIGS. 8, 9 and 10 of the drawings illustrate a further an important feature of the invention, namely, a ring 50 which can be releasably mounted on the shaft 52. The ring 50 has an inner diameter 54 which is approximately the same diameter as the shaft 52, so that it can, with the application of a small amount of force, slide up and down the shaft 52. Moreover, the ring 50 can be held so that it doesn't move, even when the shaft 52 is being rotated either clockwise or counterclockwise in the normal operation of the hand tool. The position of the ring 50 on the shaft 52 can be selected by the user so as to provide the best stability in using the hand tool, as will be described.

Preferably, the ring is made of rubber, plastic, polycarbonate, polyvinyl chloride, or any other suitable material so that it can effectively carry out its intended purpose and function.

The ring 50 has an outer diameter 56, which comprises a generally flat surface. This flat surface can be grasped between, for example, the thumb and index finger of the user, which will be helpful in stabilizing the hand tool and more easily and accurately positioning it over the screw to be engaged. The ring 50 can be continued to be held at this outer diameter 56 during the operation of the hand tool to maintain any stability that may be useful during the project. The user may choose to have this ring 50 further up the shaft 52 or further down the shaft 52, depending on personal comfort and the job requirements.

The ring 50 may further operate as a storage area for a selection of different types of bits. Therefore, between the inner diameter 54 and the outer diameter 56, the ring has a series of radially arranged compartments, such as six or seven in number, each of which is dimensioned so as to receive and hold a bit 60. A selection of bits 60 can therefore be placed on the hand tool so that they are appropriately stored but can be readily selected when needed, in a manner which is not in any way cumbersome or which may impede or interfere with the operation of the hand tool. The bits 60 in the compartments may be removed and placed in a more general supply of bits, separate from the tool, so that a user may anticipate what may be required in the job and store these on the hand tool as part of the job preparation. This eliminates or certainly reduces the need to go back and forth between a more comprehensive and spacious bit storage rack or device, providing the hand tool of the invention with a convenience factor which flows from an inclusive ability to constitute an ergonomic and useful tool, with a selection of bits stored thereon in a releasable and readily available manner.

It will be appreciated that the various bits illustrated and used with the hand tool of the invention have an operating head and a base. The operating head can take many different forms, including a flat head, a Phillips screwdriver head, a wrench or socket, to name a few. The base of each bit would be the same as all the others, and may be, for example, hexagonal or square in cross-section, so that it would fit both in the bottom end of the shaft of the hand tool in a releasable manner, as well as in the dedicated ring compartment. The tolerances would be such that each bit would be firmly held in position either in the ring compartment or at the end of the shaft, so as not to fall out under normal operation, but would be easily removable by the application of some moderate pulling force to free or replace the bit, as desired.

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

The invention claimed is:

1. A hand tool comprising:

a handle having a central area having a lower end and an upper end and a pair of outwardly extending arms at the upper end;

a shaft having a fixed end connected to the lower end of the central area and an open opposite end for receiving a tool bit;

a ratchet mechanism between the shaft and the central area to control rotational movement of the shaft, a ring releasably mounted on the shaft and capable of limited movement relative to the shaft; and a circular disk formed at the top of the central area between the outwardly extending arms.

2. A hand tool as claimed in claim 1 wherein the central area of the handle is substantially coaxial with the shaft, and the outwardly extending arms extend upwardly from and away from the central area of the handle, the outwardly extending arms and the central area defining a generally Y-shaped configuration for the handle.

3. A hand tool as claimed in claim 1 wherein the central area of the handle comprises an internal chamber for receiving the ratchet mechanism.

4. A hand tool as claimed in claim 3 wherein the internal chamber has an outer surface which forms a central area.

5. A hand tool as claimed in claim 1 wherein the ring comprises an inner surface for engagement with the shaft, and an outer surface.

6. A hand tool as claimed in claim 5 wherein the inner surface of the ring is of a diameter which is, at least partially, substantially the same as the diameter of the shaft, the inner surface engaging the shaft in a manner so that it will normally remain at a fixed point thereon, but can be moved or rotated relative to the shaft by the application of moderate force.

7. A hand tool as claimed in claim 5 wherein the outer surface of the ring is generally flat and comprises a holding or gripping surface to help the user stabilize or position in the hand tool.

8. A hand tool as claimed in claim 1 wherein the ring comprises a plurality of pockets or compartments each for receiving a selected bit such that the ring operates as a storage site for selected bits.

9. A hand tool as claimed in claim 8 wherein the ring comprises six compartments.

10. A hand tool as claimed in claim 9 wherein the open opposite end of the shaft is adapted so as to releasably receive a tool bit.

11. A hand tool as claimed in claim 10 wherein the opposite end of the shaft is substantially the same size as the compartments in the ring so that a selected tool bit can be received and accommodated in both the compartment and open opposite end of the shaft.

12. A hand tool as claimed in claim 1 wherein the ring is comprised of a material selected from one or more of the following: rubber, polycarbonate, plastic, polyvinyl chloride.

13. A hand tool as claimed in claim 1 forming part of a kit.

14. A hand tool as claimed in claim 13 wherein the kit comprises a selection of different tools including bits, nut setters, extension components, drill bits, Phillips screwdriver head, and base storage units for holding said different tools when not in use.

15. A method of forming a hand tool comprising:

forming a handle having a central area having a lower end and an upper end and a pair of outwardly extending arms at the upper end;

inserting a shaft having a fixed end connected to the lower end of the central area, the shaft having an open opposite end for receiving a tool bit;

inserting a ratchet mechanism between the shaft and the central area to control rotational movement of the shaft;

mounting a ring assembly releasably on the shaft which is capable of limited movement relative to the shaft;

mounting a circular disk at the top of the central area between the outwardly extending arms.

* * * * *